US005121626A

United States Patent [19]

Baldwin

[11] Patent Number: 5,121,626

[45] Date of Patent: Jun. 16, 1992

[54] ADJUSTABLE DIE SUPPORT FOR A PRESS BRAKE

[75] Inventor: John B. Baldwin, Warrenville, Ill.

[73] Assignee: Caterpillar Inc., Peoria, Ill.

[21] Appl. No.: 740,679

[22] Filed: Aug. 6, 1991

[51] Int. Cl.[5] ..... B21D 37/02

[52] U.S. Cl. ..... 72/482; 72/389; 72/462; 72/481; 83/698

[58] Field of Search ..... 72/389, 462, 481, 465, 72/482; 83/698

[56] References Cited

U.S. PATENT DOCUMENTS

| | | | |
|---|---|---|---|
| 4.366,698 | 1/1983 | Gill | 72/389 |
| 4.787,237 | 11/1988 | Houston et al. | 72/462 |
| 4.895,014 | 1/1990 | Houston | 72/481 |
| 4.918,971 | 4/1990 | Makino | 72/481 |
| 4.993,255 | 2/1991 | Treillet | 72/481 |

FOREIGN PATENT DOCUMENTS

| | | | |
|---|---|---|---|
| 737550 | 7/1943 | Fed. Rep. of Germany | 72/481 |
| 42354 | 4/1979 | Japan | 72/481 |
| 186220 | 7/1989 | Japan | 72/481 |

*Primary Examiner*—David Jones
*Attorney, Agent, or Firm*—Alan J. Hickman

[57] ABSTRACT

An adjustable support for a die of a press brake includes a mounting bracket which has first and second interconnected portions. A mounting device connects the first portion of the mounting bracket to the ram or bed of the press brake and maintains the second portion of the mounting bracket adjacent a bearing surface of the ram or bed of the press brake and from movement relative to the bearing surface. An adjustment device is provided for engaging the bearing surface of the die and maintaining the die from tipping movement relative to the bearing surface of the press brake during loading of the die. The adjustment device is connected to the second portion of the mounting bracket. The adjustable support is particularly suited for plate forming and bending operations.

23 Claims, 4 Drawing Sheets

ADJUSTABLE DIE SUPPORT FOR A PRESS BRAKE

TECHNICAL FIELD

This invention relates to an adjustable support for maintaining a die of a press brake from tipping movement relative to a bearing surface of the press brake during loading of the die.

BACKGROUND ART

Press brakes of the type used for forming plate, sheet, and other forms of metallic stock typically have upper and lower die sets which are clamped to the bed and ram of the press brake, respectively. Usually the upper and lower dies are configured so that the clamping system retains the dies from any undesirable excessive movement during operation of the press brake. An example of such a clamping system is shown in U.S. Pat. No. 4,787,237 to David L. Huston et al dated Nov. 29, 1988. The clamping system of this patent utilizes a pair of upper and lower jaws which are engaged with the connecting portion of the upper and lower dies, respectively. Since the upper and lower dies have a relatively narrow configuration in transverse cross-section the clamping force supplied to the jaws is may be adequate to prevent tipping movement of either of the upper and lower dies.

Upper and lower dies often vary in configuration depending upon the nature of the forming work to be done. In some applications the dies are large relative to the transverse cross-sectional thickness of the clamping portion of the ram and bed and in other applications the dies are offset relative to the transverse cross-section of the clamping portion of the ram and bed. In applications where the connection of the die to the press brake is transversely offset relative to load applying end of the die uneven loading occurs which frequently results in failure of the die. In applications where the dies are very large and the work to be formed is relatively thick, several tons of offset die loading may be applied which will result in cocking, bending and/or braking of the die at the connecting portion of the die to the press brake due to the relatively narrow cross-sectional thickness of the clamping portion.

In the applications where the load applying end of the die, the end which is engageable with the material being formed, is transversely offset from the connecting portion of the die at the connection to the press brake, uneven distribution of loading occurs. This uneven loading may cause the clamping system to fail which can cause damage to the brake press, the material being formed. Further, offset loading of the system which clamps the die to the press brake may cause premature wear which will affect the accuracy of operation and result in excessive scrap and rework.

Failure of either the die or clamping mechanism caused by the unequal distribution of loading of the die will result in undesirable down time of the brake press which can disable the manufacturing operation in which the brake press is utilized, costing the manufacture in productivity and cash receipts.

Since the cross-sectional transverse thickness of the clamping system is often relatively small in comparison to the size of the die being supported and the magnitude of the load being applied, any transverse offset of the die which will cause uneven loading of the die (tipping loads) will place undesirable loads on the clamping system and result in failure of the connecting system and the press brake.

Over time forming dies tend to wear away which causes the connection to the press brake to become sloppy. Such wear usually results in poor stock forming accuracy. Also, the sloppy fit accelerates further wear and causes premature failure of the die. In order to correct the problem the die is usually scrapped or when possible repaired. In either case there is substantial cost involved. Because of the cost of replacement or repair the problem is often neglected which ultimately results in failure of the connecting system, die and associated componentry. Should the wear become excessive, clamping of the die in position so that travel of the die longitudinally of the ram or bed will be impossible. Thus, the die will wander longitudinally during the forming operation and require frequent adjustment. Should the adjustment not be done, scrap parts will be generated.

The present invention is directed to overcoming one or more of the problems as set forth above.

DISCLOSURE OF THE INVENTION

In one aspect of the present invention, an adjustable support for a die of a press brake capable of forming metallic stock is provided. The press brake has an elevationally movable ram, a bed and a releasable connecting means for connecting the die to one of the ram and bed. The die, ram and bed each have a bearing surface. A mounting device connects a first portion of a mounting bracket to one of the ram and bed and maintains a second portion of the mounting bracket adjacent the bearing surface of one of the ram and bed and from movement relative to the one of the ram and bed bearing surface. An adjustment means engages the bearing surface of the die and maintains the die from tipping movement relative to the ram bearing surface during loading of the die. The adjustment means is connected to the second portion of the mounting bracket.

Since the adjustable support is connected to either the ram and bed and engages the bearing surface of the die any uneven loading of the die which would normally cause tipping movement is resisted by the adjustable support.

Because the adjustable support resists the force of tipping of the die the potential for damage and breakage of the ram, bed and the clamping device for releasably connecting the die to the ram is prevented. Because the mounting means connects the mounting bracket at a location adjacent at least one of the bearing surface of at least one of the ram and bed and from movement relative to the bearing surface the accuracy of the location of the second portion of the mounting bracket is maintained. As a result of this, the need for frequent adjustment of the location of the mounting bracket is prevented. Since the adjustment device includes a thrust member which is movable relative to the second portion and the die bearing surface, the ability to compensate for variations in die configuration and the location of the bearing surface of the die is achieved.

The thrust member is guided for movement in directions transverse relative to the either the ram or bed so that cocking of the thrust member is prevented and equality and accuracy of adjustment along the length of the die is achieved. Thus, the die will be fully and equally supported from tipping along its length. A moving device moves the thrust member transversely relative to the ram and/or bed so that the transverse position of the thrust member is accurately achieved. Also, the moving means enables the thrust member to be easily moved transversely of the ram and/or bed so that forcible engagement between the die and the second portion is achieved and subsequently adequate support of the die is provided.

A plurality of fasteners are provided for connecting the die to the second portion of the bracket. The plurality of fasteners each have a threaded portion and a reduced diameter cylindrical portion. The die and second portion each have a threaded aperture disposed therein and a thrust member disposed between the die and the second portion has a clearance aperture disposed therethrough. The plurality of fasteners are each movable between a stored position at which the threaded portion of the fastener is engaged with the threaded bore of the second portion and a die fastening position at which the threaded portion of the fastener is engaged with the threaded bore of the die. When the threaded fasteners are at the die fastening position the die is clamped against the thrust member and sliding motion of the thrust member is prevented. The capability of being able to move the threaded fastener to the stored position prevents the potential for damage to the threads as they are protected by the mounting bracket. Further, the ability to maintain the threaded fasteners in connection with the mounting bracket reduces the potential for misplacement and fastener loss.

The mounting means includes a link having a tapered slot disposed therein and being pivotally connected to the first portion of the mounting bracket. The slotted link is engageable with a stud connected to one of the ram and bed and positions the mounting bracket so that the second flange thereof is at a predetermined location adjacent the bearing surface of the connected to one of the ram and bed so that proper positioning of the second portion relative to the bearing surface of said one the ram and bed is maintained so that the proper positioning of the thrust member relative to the die bearing surface is achievable.

BEST MODE FOR CARRYING OUT THE INVENTION

Figure 1:
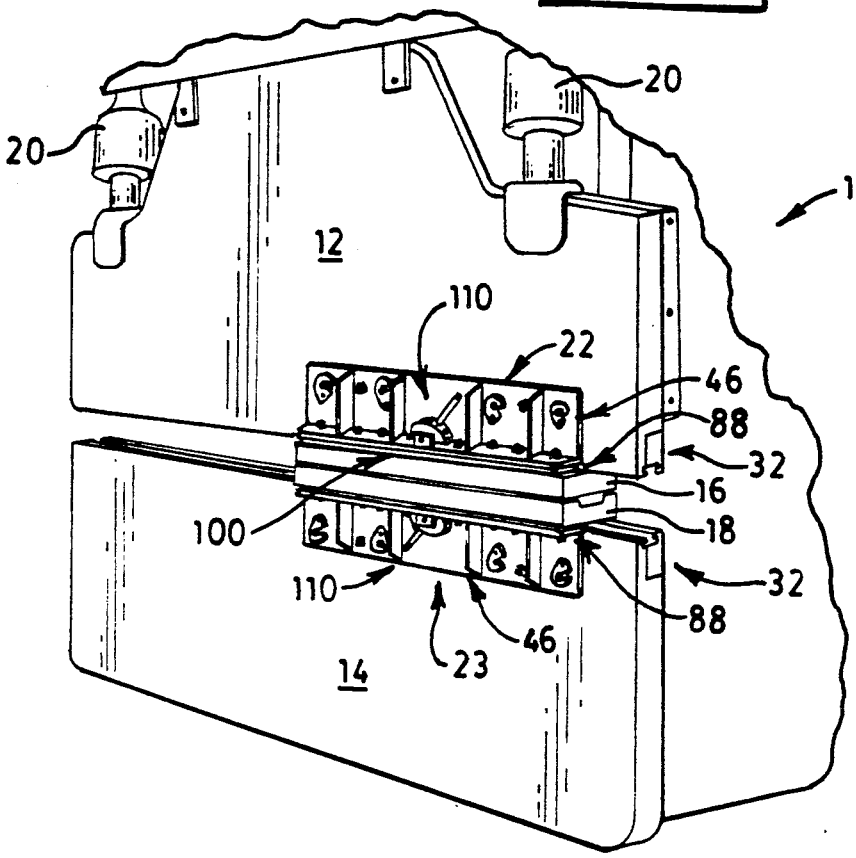
FIG. 1 is a diagrammatic isometric view of the press brake disclosing an embodiment of an adjustable support of the present invention.

With reference to the drawings, and particularly FIG. 1, a press brake 10 of the type suitable for forming and bending a plurality of different sizes and shapes of metallic stock is disclosed. The press brake has a ram 12 and a bed 14. Upper and lower dies 16, 18 are secured to the ram and bed 12, 14. The ram 12 is elevationally movable by means, including a pair of spaced apart hydraulic cylinders 20, which provides several tons of force so that metal stock disposed between the upper and lower dies 16, 18 may be formed and/or bent to a desired shape, angle, configuration and the like. The size and shape of the upper and lower dies 16, 18 may be changed as needed to accommodate the particular metal stock to be formed or bent.

A pair of adjustable supports 22, 23, one adjustable support 22 which is disclosed as being connected to the ram 12 and the other adjustable support 23 as being connected to the bed 14, are provided for maintaining the upper and lower dies 16, 18 from tipping movement relative to the ram 12 and bed 14, respectively, and transversely about a longitudinal connection between the upper die 16 and the ram 12 and the lower die 18 and the bed 14. It is to be noted that although a pair of the adjustable supports are disclosed a single adjustable support 22 may be provided on either the ram 12 or bed 14. Since the adjustable supports 22, 23 are identical in construction, connection, and relative position only the adjustable support 22 connected to the ram 12 will be discussed in detail. However, all discussion related to the adjustable support 22, associated componentry and function also pertains to the adjustable support 23 and its equivalent associated componentry and function. For example, when discussing the adjustable support 22 and its relationship and function relative to the upper die 16 the same relationship remains true for the adjustable support 23 and its relationship and function relative to the lower die 18.

Figure 2:
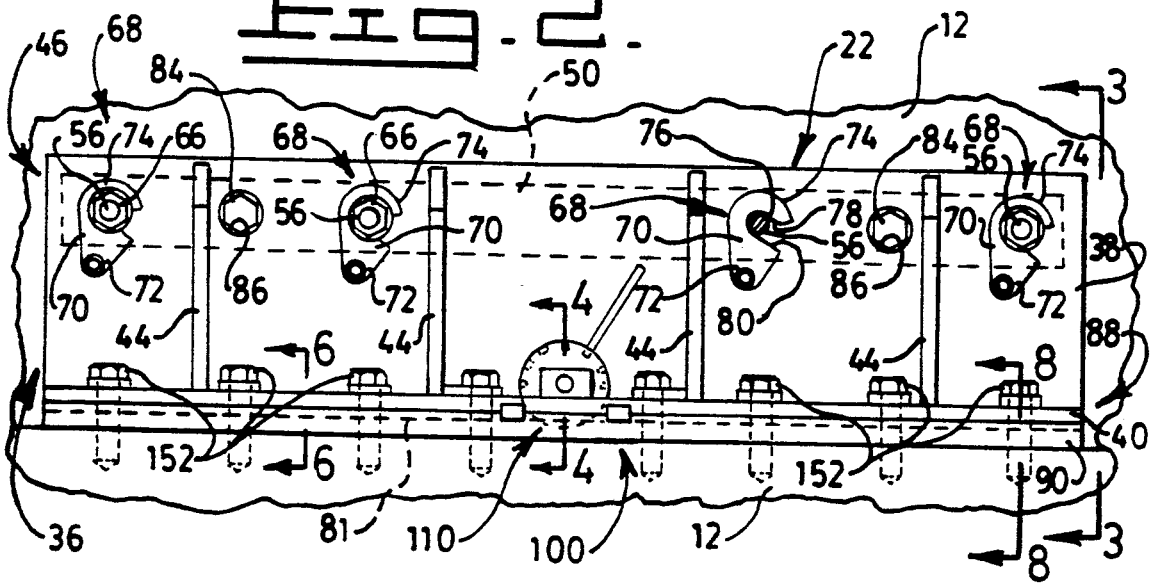
FIG. 2 discloses a diagrammatic plan view of the adjustable support of the present invention.
Figure 3:
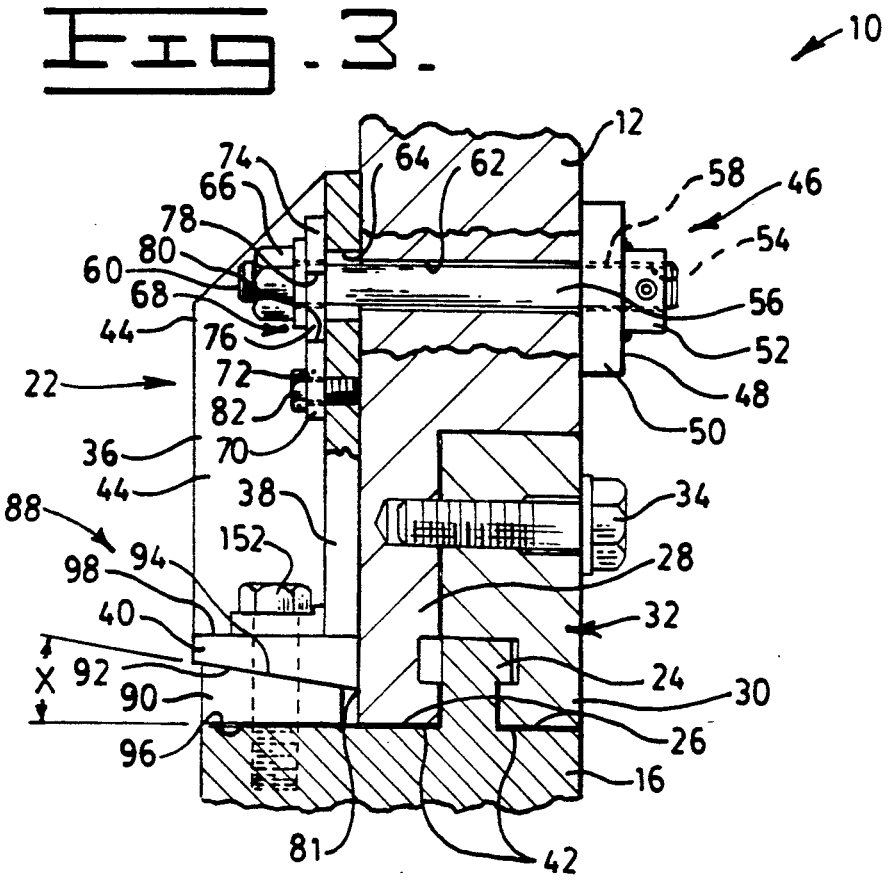
FIG. 3 discloses a diagrammatic cross-sectional view taken along lines 3—3 of FIG. 2 with portions of the ram and mounting bracket broken away to show an aspect of the present invention in greater detail.

Referring to FIGS. 2 and 3, the upper die 16 has an elongated connecting portion 24 and a die bearing surface 26 which is substantially normal to the direction of extension of the connecting portion 24. The connecting portion 24 has a hook like configuration and is received between jaws 28, 30 of a releasable connecting means 32. The jaw 28 is fixedly connected to the ram 12 and the jaw 30 is slidably engaged with the ram 12 and forcibly urged into engagement with the connecting portion 24 of the die 12 by any suitable fastening means, for example, but not limited to threaded fastener 34. The construction of the releasably connecting means 32 may include spring or pressure applied devices which are well known in the art. The only significance of the specific design of the releasable connecting means 34 is that it is capable of retaining the connecting portion 24 of the upper die 16. It is to be reiterated that the lower die 18 may be connected to the bed 14 of the press brake 10 in an equivalent manner.

The adjustable support 22 enables dies of differing configurations and sizes to be adequately supported on the ram 12 or bed 14 and prevents excessive tipping of the die 16, 18. As previously noted, tipping of the die ultimately causes failure of the releasable connecting means 32, and the die 16, 18, particularly at the connecting portion 24. The adjustable support 22 include a mounting bracket 36 which has interconnecting first and second portions 38, 40. The first portion 38 is rectangularly configured and extends longitudinally along the ram 12 at a location adjacent the jaw 28. The second portion 40, which is substantially the same length as the first portion 38, is connected to the first portion 38 and extends outwardly relative to the first portion 38 to form a substantially L-shaped configuration with portion 38. The second portion 40 is located at an end of the ram 12 defined by a ram bearing surface 42. The mounting bracket 36 has a plurality of spaced apart gussets 44 which are connected to the first and second portions and provide rigidity to the assembly and prevent undesirable and excessive deflection bending and the like of the first and second portions 38, 40. Attachment of the first and second portions 38, 40 and the gussets 44 to each other may be achieved in any manner such as by welding. Forming of the mounting bracket 36 in any manner such as by forging, casting, or the like is also suitable.

A mounting means 46 is provided for connecting the first portion 38 of the mounting bracket 36 to the ram 12 and/or bed 14 and maintains the second portion 40 of the mounting bracket 36 adjacent the ram bearing surface 42 and from movement relative to the ram bearing surface 42.

The mounting means 46 includes a plate assembly 48 having a plate 50 and a plurality of bosses 52 connected at space locations to the plate. The plate 50 is elongated in configuration and extends substantially parallel to the ram bearing surface 42 on the ram 12. The bosses 52 are affixed to the plate such as by welding at equally spaced apart locations along said plate 50. The bosses 52 and plate 50 have a threaded bore 54 disposed therethrough for screw threadably receiving a stud 56. The studs 56 each have first and second end portions 58, 60 and are connected at the first end portion 58 to the boss 52 of the plate assembly 48. The studs 56 are disposed in a plurality of spaced apart apertures 62 disposed in and extending through the ram 12. A plurality of spaced apart apertures 64 disposed in and through the first portion 38 of the mounting bracket 36 receive the second end portion 60 of the studs 56 therethrough. The apertures 64 are preferably oversized to allow for adjustment of the mounting bracket 36 in order to align the second portion 40 parallel to the ram bearing surface 42. A nut 66 is connected to the second threaded end portion 60 of each of the studs 56. The nuts 66 forcibly urge the plate 50 and first portion 38 of the mounting bracket 36 into engagement with the ram 12. Should the adjustable support 23 be provided on the bed 14 the aforementioned mounting means 46 would be suitable for connection of the mounting bracket 36 thereto.

It should be noted that the plurality of apertures 64 disposed in the first portion of the mounting bracket have a diameter greater in magnitude than the diameter of the second end portion 60 of the studs 56. A centering means 68 is provided for positioning the mounting bracket 36 at a predetermined location relative to the studs 56 so that the aforementioned parallel disposition of the second portion 40 of the mounting bracket 36 and the bearing surface 42 of the ram 12 may be achieved. The centering means 68 includes a link 70 having a first end portion 72 pivotally connected to the first portion 38 of the mounting bracket 36 and a second end portion 74 spaced from the first end portion 72. The second end portion 74 having a slot 76 disposed therethrough. The slot 76 has spaced sides 78, 80 converging radially inwardly (FIG. 2). The sides are engageable with the second end portion 60 of the stud 56 in response to forceable pivotal movement of the link 70 about the link first end portion 72. The link 70, through forceable engagement with the stud 56, urges movement of the mounting bracket36 to a centered location relative to the stud 56. The second portion 40 of the mounting bracket 36 is oriented, along a line 81 defined by a corner of the second portion 40, parallel to the bearing surface 42. The nuts 66, in addition to the aforementioned urging, maintains the links 70 from pivotal movement and eliminates undesirable and inadvertent movement of the links 70. The links 70 are each pivotally connected at their first end portion 72 to the first portion 38 of the mounting bracket 36 by a threaded fastener 82. The threaded fastener 82 can be tightened so that pivotal motion of the link is prevented once the link 70 is in a desired position.

Referring to FIG. 2, a pair of threaded fasteners 84 screwthreadably connect the plate 50 to the ram 12 and retain the plate assembly 48 on the ram 12 during installation and removal of the mounting bracket 36 from the ram 12. The threaded fasteners 84 are free from connection to the mounting bracket 36 as they are disposed in oversized apertures 86 in the first portion 38 of the mounting bracket 36. As indicated above the threaded fastener 84 may also be used to connect the plate 50 to the bed 14.

As best seen in FIG. 3, an adjustment means 88 is provided for engaging the bearing surface 26 of the upper die 16 and maintaining the upper die substantially from tipping movement relative to the ram bearing surface 42 during loading of the upper die 16. The adjustment means 88 is connected to the second portion 40 of the mounting bracket 36. Similarly, the adjustment means 88, as applied to the lower die 16, would maintain the lower die 18 substantially from tipping movement.

The adjustment means 88 includes a thrust member 90 which is disposed between the second portion 40 and the die bearing surface 26. The thrust member is movable relative to the second portion 40 and the die bearing surface 26 to a location which the thrust member 90 is forcibly engaged with the die bearing surface 42. Specifically, the second portion 40 has a thrust surface 92 and the thrust member has first and second spaced thrust surfaces 94, 96. The thrust surface 92 of the second portion 40 is at an acute angle "x" relative to the ram bearing surface 42 and the first thrust surface 94 is at an acute angle "x" relative to the second thrust surface 96. The thrust surface 92 of the second portion 40 is engageable with the first thrust surface 94 and the second thrust surface 96 is engageable with the die bearing surface 26. The angles of the thrust surface 92 and the first thrust surface 94 are substantially identical relative to the die bearing surface 26 and extend in directions transversely relative to the ram 12. The thrust member 96 is movable in directions transverse relative to the ram 12 and changes the distance between a top surface 98 of the second portion 40 of the mounting bracket 36 and the die bearing surface 26.

Figure 4:
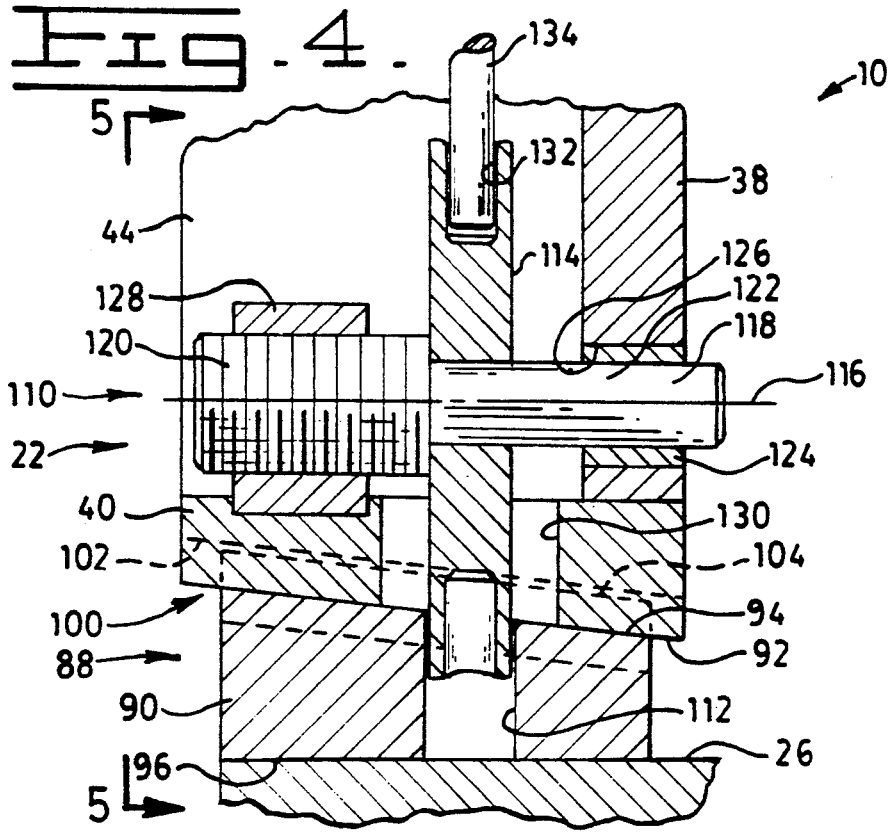
FIG. 4 is a diagrammatic cross-sectional view taken along lines 4—4 of FIG. 2 showing the moving means for selectively moving the thrust member.
Figure 5:
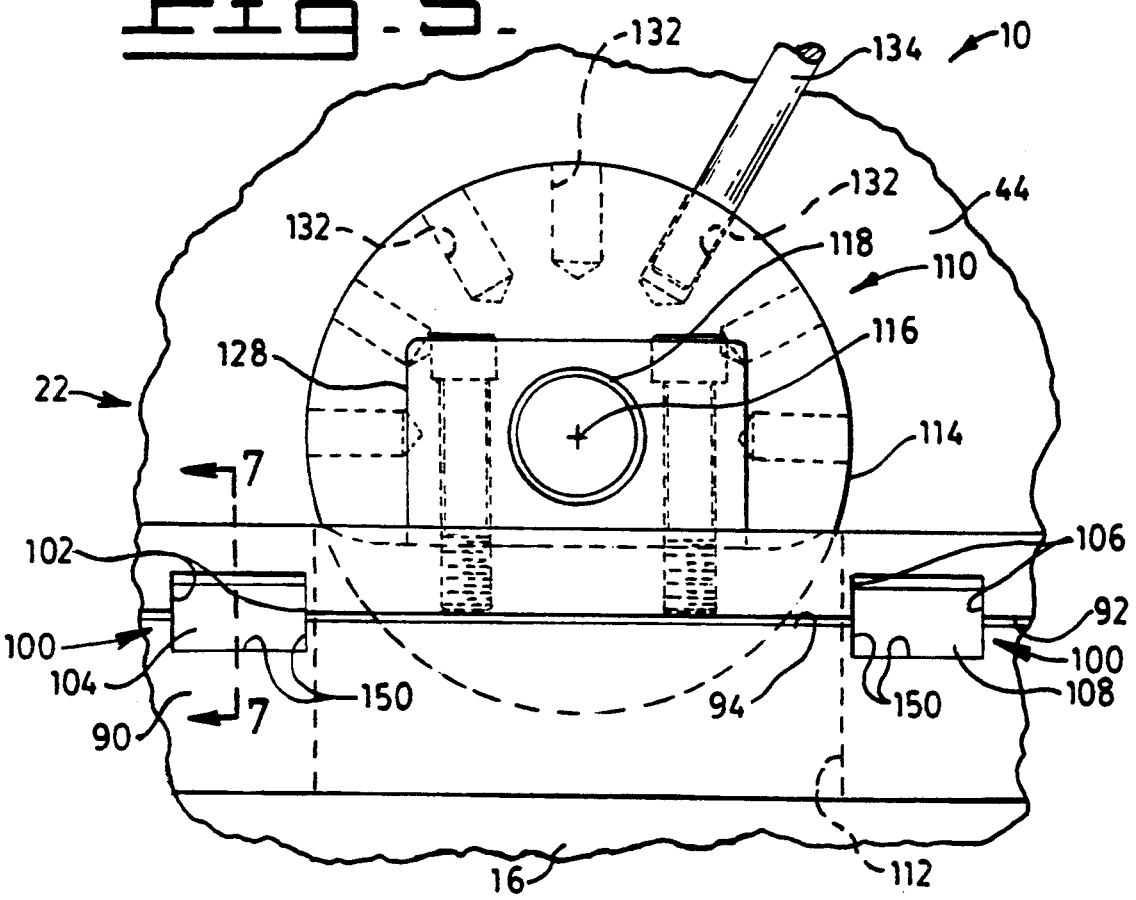
FIG. 5 is a diagrammatic view taken along lines 5—5 of FIG. 4 disclosing the moving means in greater detail and a pair of spaced apart guiding means.
Figure 7:
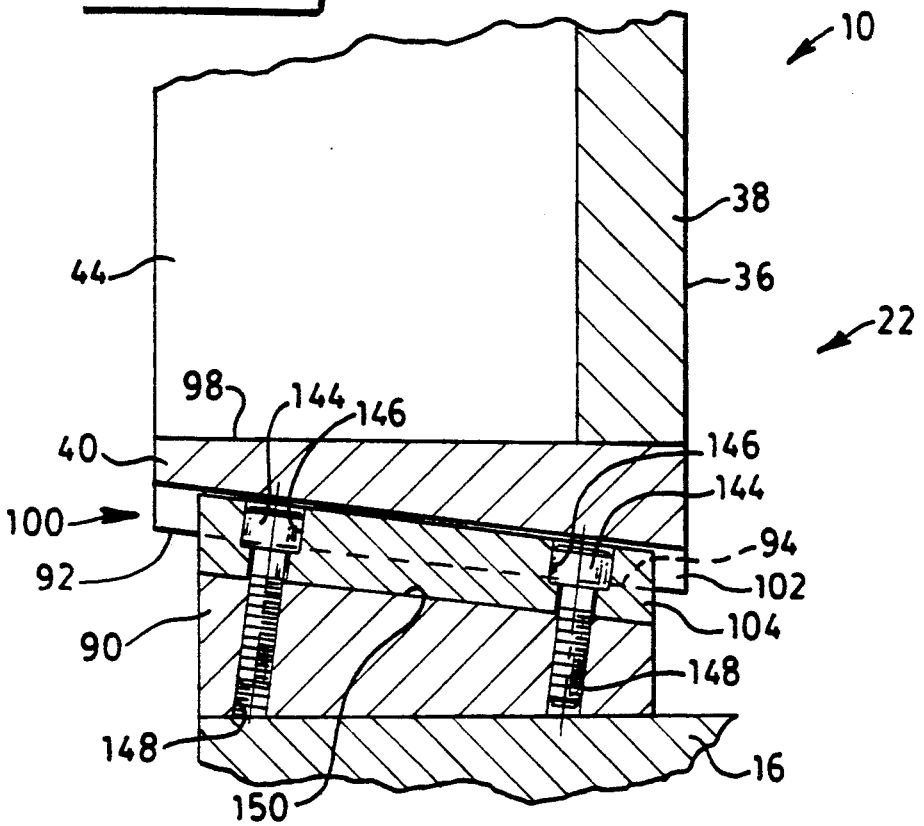
FIG. 7 is a diagrammatic cross-sectional view taken along lines 7—7 of FIG. 5 showing the guiding means in greater detail.

As best seen in FIGS. 4, 5 and 7, a guiding means 100 is provided for guiding movement of the thrust member relative to the second portion 40. Preferably, but not limited to, the guiding means guides the thrust member 90 to increase the distance between the thrust member 90 and the die bearing surface 26. The guiding means 100 preferably guides the thrust member 90 for movement in directions transverse relative to the ram 12. However, it is to be noted that guidance of the thrust member 90 in any direction capable of compensating for and increase or decrease in the distance between the second portion 40 and the bearing surface 26 of a selected one of a plurality of dies 16 would be suitable and within the spirit of the invention. Thus, linear movement of the thrust member 90 relative to the second portion 40 in directions toward and away from the die bearing surface 26 would be appropriate.

Preferably, the guiding means 100 guides the thrust member 90 for movement in the aforementioned transverse directions relative to the ram 12 and along the thrust surface 92 of the second portion 40. The guiding means also maintains the thrust member 90 from movement in directions crosswise the transverse directions in order to maintain movement of the thrust member 90 in a substantially normal direction in one component of movement relative to the ram 12.

The guiding means 100 includes a first elongated guide way 102 disposed in the second portion 40 and a first elongated guide member 104 connected to the thrust member 90. It is to be noted that although this is the preferred connection, reversal of the guide way 102 and guide member 104 are within the spirit and scope of the invention. The first elongated guide member 104 is slidably disposed in the first elongated guide way and guides the thrust member 90 for movement in the aforementioned transverse directions. A second elongated guide way 106 is disposed in the second portion and a second elongated guide member 108 is connected to the thrust member 90. Reversal of the disposition of the second elongated guide way 106 and the connection of the second elongated guide member 108 is considered within the spirit of the invention, like that of the first elongated guide way 102 and first elongated guide member 104. The first and second elongated guide members 104, 108 are spaced from and substantially parallel to each other and the first and second elongated guide ways 102, 106 are spaced from each other and substantially parallel to each other. The spacing between the guide ways 102, 106 and the first and second elongated guide members 104, 108 are identical so as to provide smooth operation and prevent cocking of the thrust member 90 along its length. The guiding means 100 insures that the location of the thrust member 90 relative to the second portion 40 is consistent along its length and thus substantially maintains parallel positioning of the die surface 26 relative to the ram bearing surface 42.

A moving means 110 is provided for selectively forcibly moving the thrust member 90 relative to the second portion 40 and the die bearing surface 26 to a location at which the thrust member 90 is engaged with both the second portion 40 and the die bearing surface 26. Thus, the thrust member 90 is moved to a location at which the die bearing surface 26 is maintainable at a preselected attitude. In most cases the preselected attitude is a position at which the die bearing surface 26 is substantially parallel to the ram bearing surface. The moving means 110 preferably moves the thrust member 90 in the transverse directions and along a path defined by a guiding means 100.

As best seen in FIGS. 2, 4 and 5, the moving means 110 includes a slot 112 disposed in the thrust member 90 and extending in a direction substantially normal to the second thrust surface 96 of the thrust member 90. The slot 112 extends longitudinally and relative to the length of the thrust member and between the first and second elongated guide members 104, 108. A disk 114 which is rotatively connected to the mounting bracket 36 is rotatable about an axis 116. The disk 114 is disposed in the slot 112 and engageable with the thrust member 90. The disk 114 is movable along the axis 116 in response to rotation of the disk 114. The thrust member is movable in the transverse directions relative to the ram 12 in response to rotation of the disk 114. Rotation of the disk 114 in a clockwise direction causes movement of the thrust member 90 in a first transverse direction and rotation of the disk in a counterclockwise direction causes translation of the thrust member 90 in a second opposite direction relative to the first transverse direction.

The disk 114 is mounted on a threaded shaft 118 screwthreadably connected to the mounting bracket 36. The threaded shaft is rotatable in response to rotation of the disk to axially advance the disk 116. Specifically, the threaded shaft 118 has a threaded end portion 120 and a reduced diameter portion 122. The disk 114 is pressed or attached to the reduced diameter portion in any suitable manner and the reduced diameter portion 122 is rotatively disposed in a bearing 124, of the sleeve type, mounted in an aperture 126 disposed normally in the first portion of the mounting bracket 36. The threaded end portion 120 is screwthreadably connected to a support member 128 which is connected to the second portion 40 of the mounting bracket 36 by cap screws. The support member 128 is spaced from the first portion 38. The disk 114 is located between the first portion 38 and the support member 128 and extends radially through an elongated aperture 130 disposed in and through the second portion 40 and into the slot 112 of the thrust member 90. The disk 114 being rigidly attached to the reduced diameter portion 122 of the shaft 118 rotates the shaft 118 in response to rotation thereof and causes the shaft 118 to move axially.

The disk 114 has a plurality of equally spaced apart radially oriented counterbores 132 disposed therein. The counterbores 132 are adapted to receive a hand lever 134. The hand lever 134 is slidably insertable in a selected one of the counterbores 132. The hand lever 132 permits forcible rotation of the disk 114 to urge the thrust member 90 transversely relative to the ram 12. It is to be noted that the maximum amount of rotation of the disk 114 for a given hand lever 134 connection is approximately 180 degrees. When the maximum amount of rotation of the disc 114 is completed for a given hand lever position the hand lever 114 is removed and inserted in another counterbore 132 so that additional rotation of the disk 114 may be achieved. Physical engagement between the flange 40 and the hand lever 134 limits the amount of rotation of the disk 114 for a given hand lever 134 and counterbore 132 connection.

Figure 6:
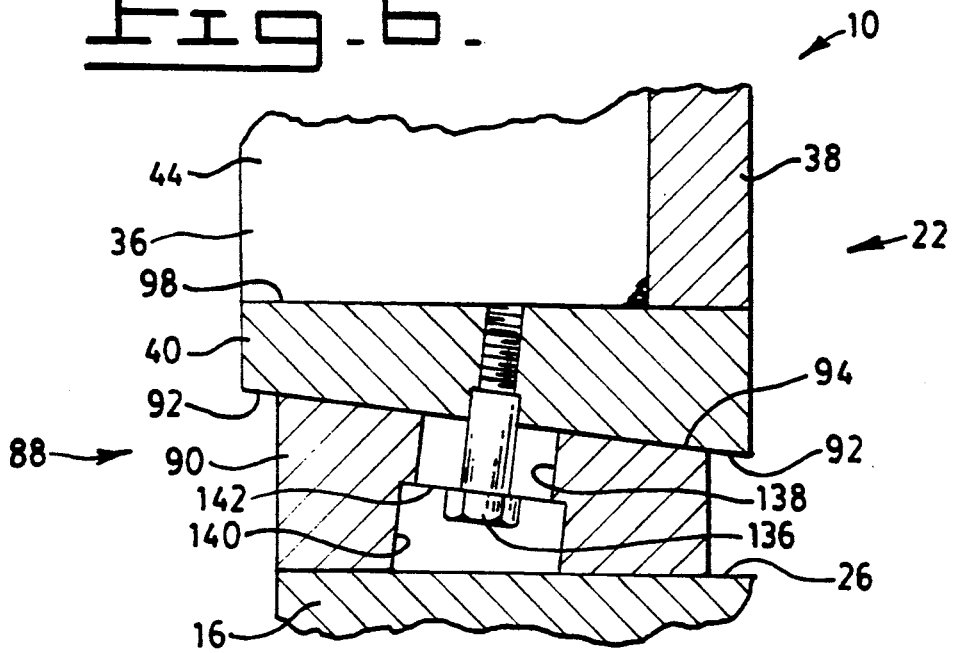
FIG. 6 is a diagrammatic cross-sectional view taken along lines 6—6 of FIG. 2 disclosing a threaded fastener for maintaining the thrust member in connection with the mounting bracket.

With reference to FIG. 6, the thrust member 90 is slidably connected to the second portion 40 by a plurality of spaced apart threaded fasteners 136 (only one shown). The threaded fasteners 136 are spaced in a direction along the length of the second portion 40 and disposed in an elongated slot 138 disposed in the thrust member 90. The threaded fastener and elongated slot are disposed perpendicular to the thrust surface 92 of the second portion 40. A counterbore 140 is disposed normally to the thrust surface 92 and defines a support surface 142 against which a head portion of the threaded fastener 136 bears. The support surface 142 is substantially parallel to the thrust surface 92 and permits slidable movement of the thrust member 90 in said transverse directions without causing binding and the like.

Referring to FIG. 7, the first and second elongated guide members 104, 108 are connected to the thrust member 90 by a pair of spaced cap screws 144 which are disposed in stepped bores 146 disposed in the first and second elongated guide members 104, 108 and screwthreadably engaged in threaded bores 148 disposed in the thrust member 90. The first and second elongated guide members 104, 108 are each disposed in elongated slots 150 disposed in the thrust member 90 and opening at the first thrust surface 94. The elongated slots 150 are oriented substantially parallel to the first and second elongated guide ways 102, 106 which maintains the first and second elongated guide members 104, 108 parallel to each other and to the first and second elongated guide ways 102, 106.

Figure 8:
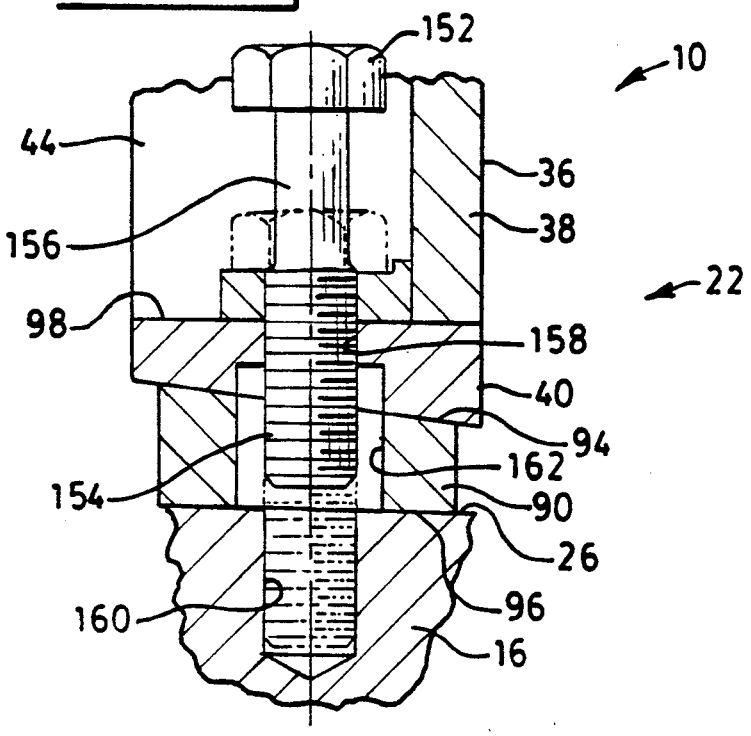
FIG. 8 is a cross-sectional view taken along lines 8—8 of FIG. 2 showing a plurality of fasteners which are movable between a stored position, as shown in solid lines, and a die clamping position as shown in phantom lines.

Referring to FIG. 8, a plurality of fasteners 152 are provided for selectively connecting the die 16 to the second portion 40 and maintaining the die in forcible engagement with the thrust member 90 and from transverse movement relative to the second portion. Specifically, the fasteners 152 are movable relative to the second portion 40 between a stored position (as shown in solid lines) at which the fasteners are screwthreadably connected to the second portion 40 and a die fastening position (as shown in phantom lines) at which the fasteners are screwthreadably connected to the die 16 and free from screwthreadable connection with the second portion 40. The threaded fasteners 152 are at the stored position whenever the dies 16 are being changed and at the die fastening position whenever the dies are in position and ready for operation on the press brake 10. Specifically, the fasteners 152 have a threaded portion 154 and a reduced diameter cylindrical portion 156. The second portion 40 of the mounting bracket 36 has a plurality of spaced threaded bores 158 lying longitudinally along the second portion 40 and extending through the second portion 40. The dies 16 each have a plurality of spaced threaded blind bores 160 disposed therein and opening at the die bearing surface 26. The threaded bores 158 and blind bores 160 are axially aligned with each other when the die 16 is connected to the ram 12 so that the threaded portion 154 of the fasteners 152 may be screwthreadably engaged with the die 16. The thrust member 90 has a plurality of spaced apart bores 162 disposed therethrough and opening at the first and second thrust surfaces 94, 96 of the thrust member 90. The bores 162 are preferably oversized relative to the size of the fasteners 152 and of a magnitude suitable to allow adequate transverse travel of the thrust member 90 for adjustment purposes. Also, the spaced apart bores 162 allow for the passing of the threaded fastener 152 therethrough so that clamping of the die 16 to the thrust member 90 and the thrust member 90 to the second portion 40 may be achieved.

INDUSTRIAL APPLICABILITY

With reference to the drawings, and in operation, the adjustable support 22, 23 enables a variety of dies 16, 18 of differing sizes and configurations to be utilized without causing damage to the releasable connecting means 32 or the connecting portion 24 of the selected die 16. The adjustable support 22, 23 also allows for adjustment in situations where the dies 16 have been used a number of times and the tolerances of the dies 16, 18 have changed so that the dies 16 are no longer held accurately in position by the releasable connecting means 32. The adjustment means 88 enables accurate adjustment of the adjustable support 22, 23 so that the dies 16, 18 may be held in the proper position irrespective of the size and shape of the die 16, 18 and wear of the die 16, 18 caused by use and/or improper care.

To install the adjustable support 22, 23 on either or both the ram 12 or bed 14 of the press brake 10 is a simple task which requires little effort and a low degree of skill. Since the installation on either the ram 12 or bed 14 would be identical, the following discussion will be with respect to the ram 12, however, one should recognize that the installation also pertains to connection to the bed 14. To install the adjustable support 22 on the ram 12 one simply inserts the studs 56 of the plate assembly 48 in the apertures 62 of the ram 12 and fastens the plate assembly 48 to the ram 12 by threaded fasteners 84. The mounting bracket 36, and particularly the first portion 38, is hung on the studs 56 by placement of the apertures 64 about the studs 56. The centering means 68 and particularly the links 70 are then rotated about their pivotal connection (threaded fastener 82) until the sides 78, 80 of the slot of each link 70 are engaged with a respective stud 56. At this position the line 81 defined by the corner of the second portion 40 of the mounting bracket 36 is substantially parallel to the ram bearing surface 42. The nuts 66 are then placed on the studs 56 which secures the mounting bracket 36 from subsequent movement during the forming operations. The threaded fasteners 82 may be securely fastened to lock the links 70 from pivotal movement, however, the nut 66 would be sufficient to prevent any movement without such action.

One of a plurality of dies 16 is selected for installation on the ram 12, depending on the type of forming operation to be performed. The die 16 is installed on the ram 12 by simply inserting the connecting portion 24 between the jaws 28, 30 and urging the jaws 28, 30 toward each other by tightening threaded fasteners 34.

The thrust member 90 is then moved transversely relative to the ram 12 by simply rotating disk 114. As the disk 114 moves along axis 116 the disk 114, by virtue of contact with the thrust member 90 in the slot 112 and translation of the threaded portion 120, forces movement of the thrust member 90. The guiding means 100 insures that the thrust member 90 moves along the proper path and maintains the proper orientation of the thrust member along the full length of the thrust member 90. When the die bearing surface 26 is engaged with the thrust member 9 and properly oriented, rotation of the disk by lever 134 is stopped. Should the tolerances of the die change over time due to wear and the like further adjustment may be made by simply rotating the disk 114 by hand lever 134. It should be noted that the hand lever 134 is required as a substantial amount of force may be needed to properly position the thrust member 90 and the die surface 26.

When the thrust member is in the proper position the fasteners 152 are moved from the stored position to the die fastening position by rotating the fastener 152 until it is unscrewed from the threaded bores 158 in the second portion 40 of the mounting bracket 36 and screwthreadably engaged in the blind bores 160 of the die 16. As previously indicated torquing of the bolts 152 to clamp the die against the thrust member 90 retains the thrust member 90 at the proper position and prevents transverse and longitudinal movement of the thrust member 90 and tipping and longitudinal movement of the die 16.

Upon completion of the installation of the upper and lower dies 16, 18 and the adjustable support(s) 22, 23 and the brake press 10 is ready for use. Replacement of various dies 16, 18 with dies of differing sizes and shapes is achieved by simply moving the fasteners 152 to the stored position and releasing the releasable connecting means 32 from forceable connection with the die 16, 18.

Other aspects, objects and advantages of the present invention can be obtained from a study of the drawings, the disclosure and the appended claims.

I claim:

1. An adjustable support for maintaining a die of a press brake capable of forming metallic stock from tipping movement relative to one of a ram and bed of said press brake, said die, ram and bed having a bearing surface; comprising:

an elongated connecting portion connected to the bearing surface of said die;

means for releasably connecting the connecting portion of the die to one of the ram and bed and maintaining the bearing surface of the die adjacent the bearing surface of said one of the ram and bed;

a mounting bracket having interconnected first and second portions;

mounting means for connecting the first portion of the mounting bracket to said one of the ram and bed and maintaining the second portion of the mounting bracket adjacent the bearing surface of said one of the ram and bed; and adjustment means for engaging the bearing surface of said die at a location on the bearing surface of the die spaced transversely from the connecting portion and maintaining said die from tipping movement relative to the bearing surface of said one of the ram and bed during loading of the die, said adjustment means being connected to the second portion of the mounting bracket.

2. An adjustable support, as set forth in claim 1, wherein said adjustment means includes a thrust member disposed between the second portion and the die bearing surface, said thrust member being movable relative to the second portion and the die bearing surface to a location at which the thrust member is forcibly engaged with the bearing surface of the die.

3. An adjustable support, as set forth in claim 2, including means for guiding movement of the thrust member relative to the second portion.

4. An adjustable support, as set forth in claim 3, including moving means for selectively forcibly moving said thrust member relative to the second portion and the die bearing surface to a location at which the thrust member is engaged with the second portion and the die bearing surface and the die bearing surface is substantially parallel to said one of the ram and bed bearing surfaces.

5. An adjustable support, as set forth in claim 2, where in the second portion of said mounting bracket has a thrust surface and the thrust member has first and second spaced thrust surfaces, said thrust surface of the second portion being at an acute angle relative to the bearing surface of said one of the ram and bed and said first thrust surface being at an acute angle relative to the second thrust surface, said thrust surface of the second portion being engageable with the first thrust surface and said second thrust surface being engageable with the die bearing surface.

6. An adjustable support, as set forth in claim 5, wherein said thrust member is movable in directions transverse relative to said one of ram and bed to change distance between the second portion of the bracket member and the die bearing surface.

7. An adjustable support, as set forth in claim 6, including means for guiding movement of the thrust member in said transverse directions relative to said one of the ram and bed.

8. An adjustable support, as set forth in claim 7, wherein said guiding means includes a first elongated guide way disposed in one of the thrust member and second portion and a first elongated guide member connected to the other of the thrust member and second portion, said first elongated guide member being slidably disposed in the first elongated guide way.

9. An adjustable support, as set forth in claim 8, wherein said guiding means includes a second elongated guide way disposed in one of the thrust member and second portion and a second elongated guide member connected to the other of the thrust member and second portion, said second elongated guide member being slidably disposed in the first elongated guide way, said first and second elongated guide members being spaced from each other and substantially parallel to each other, and said first and second elongated guide ways being spaced from each other and substantially parallel to each other.

10. An adjustable support, as set forth in claim 9, including moving means for selectively forcibly moving said thrust member in said transverse directions and to a location at which the thrust member is engaged with both the second portion and the die bearing surface and the die bearing surface is substantially parallel to the said one of the ram and bed bearing surfaces.

11. An adjustable support, as set forth in claim 7, wherein said guiding means maintaining said thrust member from movement in directions crosswise said transverse directions.

12. An adjustable support for a die of a press brake capable of forming metallic stock, said press brake having a ram and a bed and means for releasably connecting the die to one of the ram and bed, said die, ram and bed having a bearing surface, comprising:

a mounting bracket having interconnected first and second portions, said second portion of said mounting bracket having a thrust surface;

mounting means for connecting the first portion of the mounting bracket to one of the ram and bed and maintaining the second portion of the mounting bracket adjacent the bearing surface of said one of the ram and bed and from movement relative to the bearing surface of said one of the frame and bed;

adjustment means for engaging the bearing surface of said die and maintaining said die from tipping movement relative to the bearing surface of said one of the ram and bed during loading of the die, said adjustment means being connected to the second portion of the mounting bracket;

said adjustment means including a thrust member having first and second thrust surfaces disposed between the second portion and the die bearing surface, said thrust surface of the second portion being at an acute angle relative to the bearing surface of said one of the ram and bed and said first thrust surface being at an acute angle relative to the second thrust surface, said thrust surface of the second portion being engageable with the first thrust surface and said second thrust surface being engageable with the die bearing surface, said thrust member being movable transversely relative to the second portion and the die bearing surface and said one of the bed and ram to a location at which the distance between the second portion of the bracket member and the die bearing surface is changed and the thrust member is forcibly engaged with the bearing surface of the die;

means for guiding movement of the thrust member in said transverse directions relative to said one of the ram and bed, said guiding means includes first and second spaced substantially parallel elongated guide ways disposed in one of the thrust member and second portion, first and second spaced substantially parallel elongated guide members connected to the other of the thrust member and second portion, said first and second elongated guide members being slidably disposed in the first and second elongated guide ways, respectively.

moving means for selectively forcibly moving said thrust member in said transverse directions and to a location at which the thrust member is engaged with both the second portion and the die bearing surface and the die bearing surface is substantially parallel to the said one of the ram and bed bearing surfaces, said moving means including a slot disposed in the thrust member and a disc rotatively connected to the mounting bracket and rotatable about an axis, said disc being disposed in said slot and engageable with said thrust member, said disc being movable along said axis and said thrust member being movable in said transverse directions in response to rotation of said disc.

13. An adjustable support, as set forth in claim 12, wherein said disc is mounted on a threaded shaft having an axis and being screw threadably connected to the mounting bracket, said threaded shaft being rotatable in response to rotation of said disc and said disc being axially movable in response to rotation of said shaft.

14. An adjustable support, as set forth in claim 12, wherein said disc is located between the first and second elongated guide ways.

15. An adjustable support, as set forth in claim 12, including a hand lever connected to the disc and adapted to rotate the disc.

16. An adjustable support for a die of a press brake capable of forming metallic stock, said press brake having a ram and a bed and means for releasably connecting the die to one of the ram and bed, said die, ram and bed having a bearing surface; comprising:

a mounting bracket having interconnected first and second portions;

mounting means for connecting the first portion of the mounting bracket to one of the ram and bed and maintaining the second portion of the mounting bracket adjacent the bearing surface of said one of the ram and bed and from movement relative to the bearing surface of said one of the ram and bed; and adjustment means for engaging the bearing surface of said die and maintaining said die from tipping movement relative to the bearing surface of said one of the ram and bed during loading of the die, said adjustment means being connected to the second portion of the mounting bracket, said adjustment means having a thrust member disposed between the second portion and the die bearing surface, said thrust member being movable relative to the second portion and the die bearing surface to a location at which the thrust member is forcibly engaged with the bearing surface of the die;

means for guiding movement of the thrust member relative to the second portion, moving means for selectively forcibly moving said thrust member relative to the second portion and the die bearing surface to a location at which the thrust member is engaged with the second portion and the die bearing surface and the die bearing surface is substantially parallel to said one of the ram and bed bearing surfaces, said moving means having a slot disposed in the thrust member and a disc rotatively connected to the mounting bracket and rotatable about an axis, said disc being disposed in said slot and engageable with said thrust member, said disc being movable along said axis and said thrust member being movable to said location in response to rotation of said disc.

17. An adjustable support for a die of a press brake capable of forming metallic stock, said press brake having a ram and a bed and means for releasably connecting the die to one of the ram and bed, said die, ram and bed having a bearing surface; comprising:

a mounting bracket having interconnected first and second portions;

mounting means for connecting the first portion of the mounting bracket to one of the ram and bed and maintaining the second portion of the mounting bracket adjacent the bearing surface of said one of the ram and bed and from movement relative to the bearing surface of said one of the ram and bed; and adjustment means for engaging the bearing surface of said die and maintaining said die form tipping movement relative to the bearing surface of said one of the ram and bed during loading of the die, said adjustment means being connected to the second portion of the mounting bracket, said adjustment means having a thrust member disposed between the second portion and the die bearing surface, said second portion of said mounting bracket having a thrust surface and said thrust member having first and second spaced thrust surfaces, said thrust surface of the second portion being at an acute angle relative to the bearing surface of said one of the ram and bed an said first thrust surface being at an acute angle relative to the second thrust surface, said thrust surface of the second portion being engageable with the first thrust surface and said second thrust surface being engageable with the die bearing surface, said thrust member being slidably connected to the second portion by a plurality of threaded fasteners screw threadably connected to the second portion and disposed in elongated apertures in the thrust member, said threaded member being normal to the acute angle of the thrust surface of the mounting bracket second portion, said thrust member being movable relative to the second portion and the die bearing surface to a location at which the thrust member is forcibly engaged with the bearing surface of the die.

18. An adjustable support for a die of a press brake capable of forming metallic stock , said press brake having a ram and a bed and means for releasably connecting the die to one of the ram and bed, said die, ram and bed having a bearing surface; comprising:

a mounting bracket having interconnected first and second portions;

mounting means for connecting the first portion of the mounting bracket to one of the ram and bed and maintaining the second portion of the mounting bracket adjacent the bearing surface of said one of the ram and bed and from movement relative to the bearing surface of said one of the ram and bed; and adjustment means of reengaging the bearing surface of said die and maintaining said die from tipping movement relative to the bearing surface of said one of the ram and bed during load of the die, said adjustment means being connected to the second portion of the mounting bracket, said adjustment means having a thrust member disposed between the second portion and the die bearing surface, said second portion of said mounting bracket having a thrust surface and said thrust member having first and second spaced thrust surfaces, said thrust surface of the second portion being at an acute angle relative to the bearing surface of said one of the ram and bed and said first thrust surface being at an acute angle relative to the second thrust surface, said thrust surface of the second portion being engageable with the first thrust surface and said second thrust surface being engageable with the die bearing surface, said thrust member being movable relative to the second portion and the die bearing surface to a location at which the thrust member is forcibly engaged with the bearing surface of the die;

a plurality fasteners having a threaded portion and a reduced diameter cylindrical portion;

a plurality of spaced apart threaded bores disposed in the die and opening at the die bearing surface;

a plurality of spaced apart bores disposed in the thrust member and opening at the first and second thrust surface;

a plurality of spaced threaded bores disposed in the second portion of the bracket, said threaded bores in the die and second portion, and said bores in the thrust member being axially aligned, said fasteners being disposed in the bores of the thrust member and screw threadably connected to the threaded bores in one of the die and second portion, said fasteners being at a stored position and free from connection to the die in response to being screw threadably engaged in the threaded bores of the second portion and in a die fastening position at which the die is clamped against the thrust member in response to being screwthreadably engaged in the threaded bores of the die.

19. An adjustable support for a die of a press brake capable of forming metallic stock, said press brake having a ram and a bed and means for releasably connecting the die to one of the ram and bed, said die, ram and bed having a bearing surface; comprising:

a mounting bracket having interconnected first and second portions;

mounting means for connecting the first portion of the mounting bracket to one of the ram and bed and maintaining the second portion of the mounting bracket adjacent the bearing surface of said one of the ram and bed and from movement relative to the bearing surface of said one of the ram and bed, said mounting means including;

a plate assembly having a plate and a plurality of bosses connected at spaced locations to the plate, said bosses and plate each having axially aligned threaded bores disposed therethrough, a plurality of spaced apertures disposed in said one of the ram and bed, a plurality of studs having first and second end portions and being threaded at said first and second end portions, said studs being disposed in said one of the ram and bed apertures and screw threadably connected at the first end portion of the stud to the plate assembly, said plate being engaged with said one of the ram and bed, a plurality of apertures disposed in the first portion of the mounting bracket and extending through the first portion of the mounting bracket, said second end portion of the studs being disposed in and extending through the apertures disposed in the first portion of the mounting bracket, and a plurality of nuts connected to the second threaded end portion of the studs and urging the plate and first portion of the mounting bracket into engagement with said one of the ram and bed; and adjustment means for engaging the bearing surface of said die and maintaining said die from tipping movement relative to the bearing surface of said one of the ram and bed during loading of the die, said adjustment means being connected to the second portion of the mounting bracket.

20. An adjustable support, as set forth in claim 19, wherein said plurality of apertures disposed in the first portion of the mounting bracket having a diameter greater in magnitude than a diameter of the second end portion of the stud, and including centering means for positioning the mounting bracket at a predetermined location relative to the studs.

21. An adjustable support, as set forth in claim 20, wherein said centering means includes a link having a first end portion pivotally connected to the first portion of the mounting bracket and a second end portion having a slot, said slot having a converging spaced sides and being engageable with the second end portion of the stud in response to pivotal movement of the link about the link first end portion, said link urging the mounting bracket to the predetermined location in response to pivotal movement about the first end portion.

22. An adjustable support for maintaining a die of a press brake from tipping relative to one of a ram and a bed of the press brake, said die, ram, and bed each having a bearing surface; comprising:

a connecting portion connected to and extending from the bearing surface of said die;

means for releasably connecting a connecting portion of the die to one of the ram and bed an maintaining the bearing surface of the die adjacent the bearing surface of said one of the ram and bed;

a mounting bracket having interconnected first and second portions, said second portion having a top surface;

mounting means for connecting the first portion of the mounting bracket to said one of the ram and bed and maintaining the second portion of the mounting bracket at a preselected location relative to the bearing surface of said one of the ram and bed;

a thrust member movably disposed between the second portion of the mounting bracket and the bearing surface of the die, said thrust member being engageable with the bearing surface of the die at a location on the bearing surface of the die spaced from the connecting portion of the die;

a guide way disposed in one of the second flange and thrust member;

a guide member connected to the other of the second flange and thrust member and being slidably disposed in the guide way;

moving means for selectively forcibly moving said thrust member along said guide way and changing the relative distance between the said top surface and the bearing surface of said die.

23. An adjustable support, as set forth in claim 22, wherein said moving means includes a disc having an axis of rotation and being rotatively connected to the mounting bracket, said thrust member being movable along said guide way in response to rotation of said disc.

* * * * *

UNITED STATES PATENT AND TRADEMARK OFFICE

CERTIFICATE OF CORRECTION

PATENT NO. : 5,121,626

DATED : June 16, 1992

INVENTOR(S) : John B. Baldwin

It is certified that error appears in the above-identified patent and that said Letters Patent is hereby corrected as shown below:

Claim 17, Column 14, line 45, delete "an" and insert --and--.

Claim 18, Column 14, line 62, delete "stock ," and insert --stock,--.

Claim 18, Column 15, line 7, delete "of reengaging" and insert --means for engaging--.

Claim 18, Column 15, line 10, delete "load" and insert --loading--.

Claim 20, Column 16, line 27, delete "having" and insert --have--.

Claim 22, Column 16, line 49, delete "an" and insert --and--.

Signed and Sealed this

Nineteenth Day of October, 1993

Bruce Lehman

*Attest:*

BRUCE LEHMAN

*Attesting Officer*

*Commissioner of Patents and Trademarks*